US005317359A

United States Patent [19]

Sherburne

[11] Patent Number: 5,317,359

[45] Date of Patent: May 31, 1994

[54] APPARATUS FOR PROCESSING PHOTOSENSITIVE MATERIAL

[75] Inventor: David G. Sherburne, Ontario, N.Y.

[73] Assignee: Eastman Kodak Company, Rochester, N.Y.

[21] Appl. No.: 956,135

[22] Filed: Oct. 2, 1992

[51] Int. Cl.[5] ..... G03D 3/02

[52] U.S. Cl. ..... 354/324

[58] Field of Search ..... 354/319-324, 354/331, 336

[56] References Cited

U.S. PATENT DOCUMENTS

| | | | |
|---|---|---|---|
| 4,101,919 | 7/1978 | Ammann | 354/319 |
| 4,688,917 | 8/1987 | Muller et al. | 354/320 |
| 4,989,028 | 1/1991 | Hall et al. | 354/324 |
| 4,994,840 | 2/1991 | Hall et al. | 354/324 |
| 5,059,997 | 10/1991 | Hall et al. | 354/324 |
| 5,063,951 | 11/1991 | Bard et al. | 134/64 R |

*Primary Examiner*—D. Rutledge
*Attorney, Agent, or Firm*—Frank Pincelli

[57] ABSTRACT

An improvement in an apparatus for processing photosensitive materials having an upper and lower tanks for holding processing fluid. The tanks are coupled together so that processing fluid can flow freely from the lower tank to the upper tank. A processing chamber is provided between the upper and lower tanks through which the photosensitive material can be advanced for processing. The processing chamber has an entrance at one end and an exit at the other end which allows the photosensitive material to travel through the chamber. Processing fluid is supplied from the upper tank to the processing chamber to create a first layer on one side of the photosensitive material. A first drain is provided for removing processing fluid from the first layer. Processing fluid from the lower tank is supplied to the processing chamber to create a second fluid layer on the opposite side of the photosensitive material. A second drain is provided for removing processing fluid from the second fluid layer. The outlet of the drains are located at substantially the same level so that substantially equal fluid back pressure is applied at the first and second drains.

24 Claims, 6 Drawing Sheets

APPARATUS FOR PROCESSING PHOTOSENSITIVE MATERIAL

FIELD OF THE INVENTION

The present invention relates to an apparatus for processing photosensitive materials, such as sheets of x-ray film.

BACKGROUND OF THE INVENTION

The present invention is directed to a processing apparatus of the type which includes an upper tank and a lower tank for holding processing fluid and a narrow processing chamber located between the tanks through which a sheet of photosensitive material is advanced for processing of latent images on the material. Processing fluid is delivered to opposite sides of the photosensitive material from each of the tanks for forming a fluid layer on each side of the photosensitive material. A return drain is provided on each side of the photosensitive material for removing and returning the processing fluid to the sump tank. Examples of such devices are illustrated in U.S. Pat. Nos. 4,989,028; 4,994,840and 5,059,997. Such devices are often referred to as fluid suspension processors.

In fluid suspension processors of the prior art it is important to maintain the photosensitive material suspended in the processing fluid. It has been found that excessive contact of the photosensitive material with the sides of the processing chamber results in numerous undesirable artifacts being produced on the photosensitive material. In this regard, the prior art teaches the providing the processing fluid to the entrance of the chamber at a substantially equal pressure on both sides of the photosensitive material. In order to control the amount of fluid being removed from each side of the film, return passages, which form the drains, are adjusted in size in an attempt to control the back pressure being experienced on both sides of the film. A problem with this method is that the size of the openings is directly dependent upon the flow rate into the chamber from both the upper and lower tanks. As the flow rate fluctuates the back pressure at the drain will vary significantly such that the photosensitive material will no longer be in a stable position between the two fluid layers. This unstable condition results in the film contacting the sides of narrow processing chamber which in turn results in artifacts being formed on the photosensitive material. Controlling the flow rate is extremely difficult to accomplish and maintain in processors of the prior art. Thus, it is extremely difficult to provide a pressure balanced system in prior art processors.

The present invention is directed to solving the problems experienced in prior art fluid suspension processors by providing means for equalizing the back pressure of the processing fluid at the drains on both sides of the film so as to stabilize the photosensitive material in the chamber and thereby minimize contact with the sides of the chamber.

SUMMARY OF THE INVENTION

The present invention relates to an improvement in an apparatus for processing photosensitive materials having an upper and lower tank for holding processing fluid. The tanks are coupled together so that processing fluid can flow freely from the lower tank to the upper tank. A narrow processing chamber is provided between the upper and lower tanks through which the photosensitive material can be advanced for processing. The processing chamber has an entrance at one end and an exit at the other end which allows the photosensitive material to travel through the processing chamber. A first supply means is provided for supplying processing fluid from the upper tank to the processing chamber to create a first layer on one side of the photosensitive material. A first drain is provided for removing processing fluid from the first layer. A second supply means is provided for supplying processing fluid from the lower tank to the processing chamber to create a second fluid layer on the opposite side of the photosensitive material. A second drain is provided for removing processing fluid from the second fluid layer. Means are provided for substantially equalizing the pressure of the processing fluid at the first and second drains.

BRIEF DESCRIPTION OF THE DRAWINGS

In the Detailed Description of the Preferred Embodiment of the invention presented below, reference is made to the accompanied drawing, in which.

DETAILED DESCRIPTION OF THE PREFERRED EMBODIMENT

Figure 1:
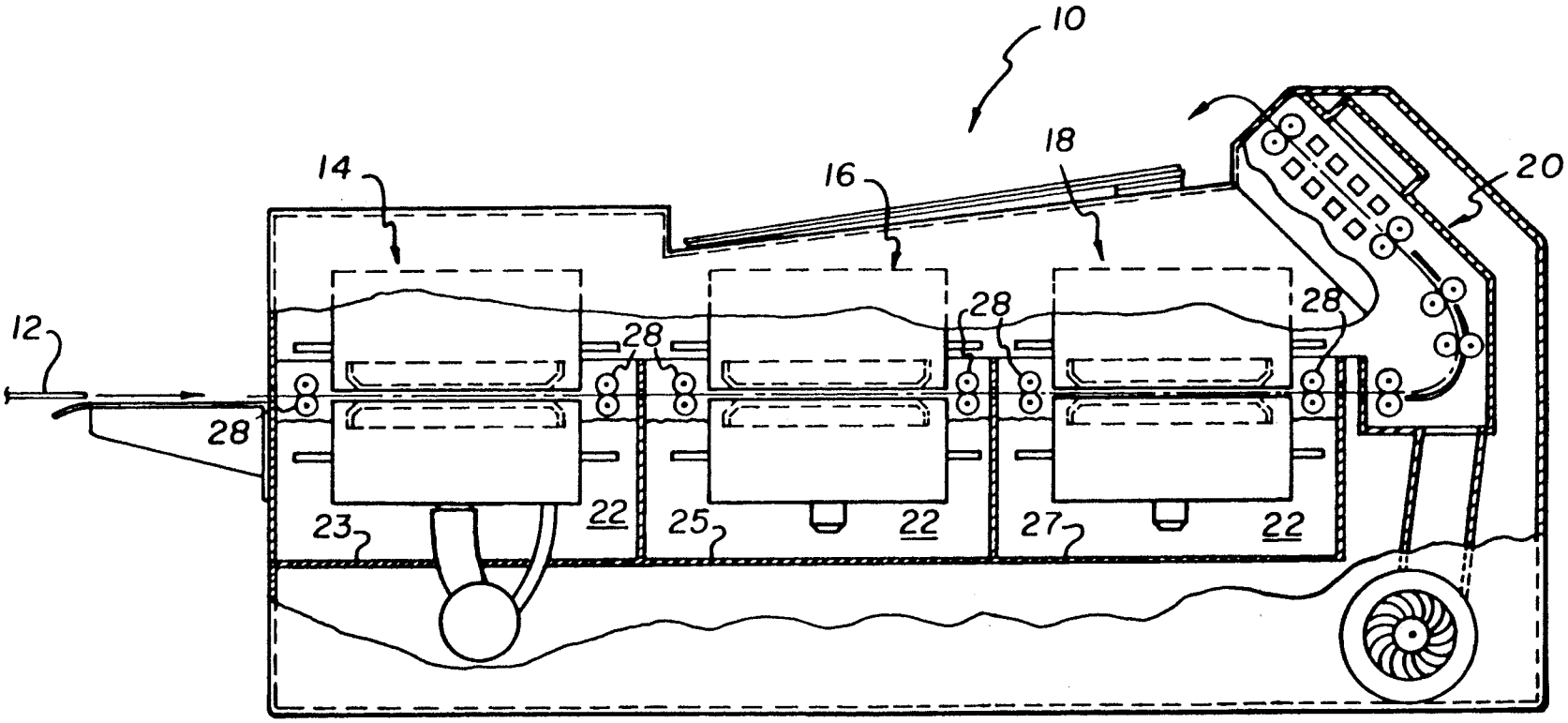
FIG. 1 is a cross-sectional view of a photographic processing apparatus made in accordance with the present invention.
Figure 2:
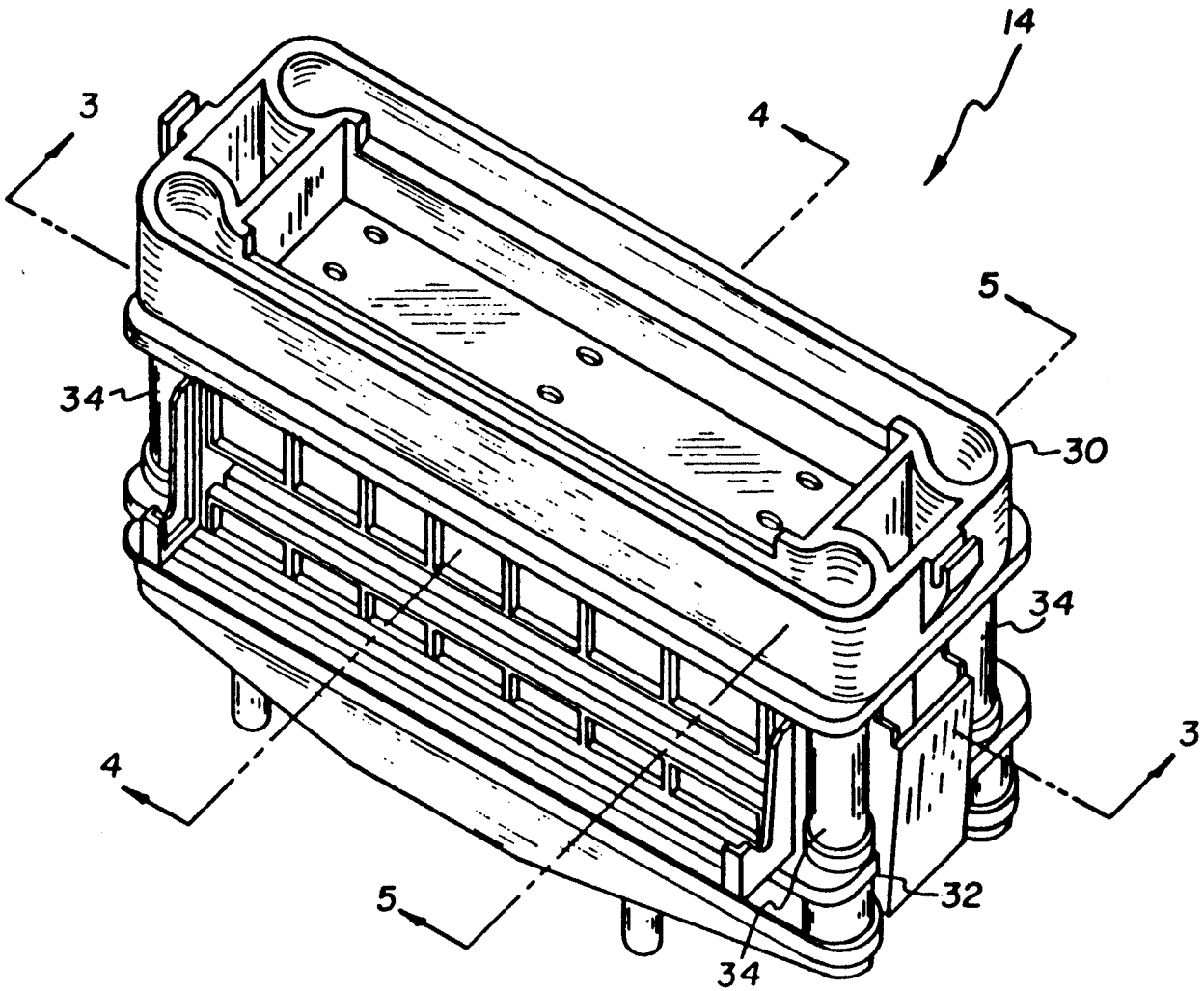
FIG. 2 is a perspective view of one of the processing units of the processing apparatus of FIG. 1.
Figure 3:
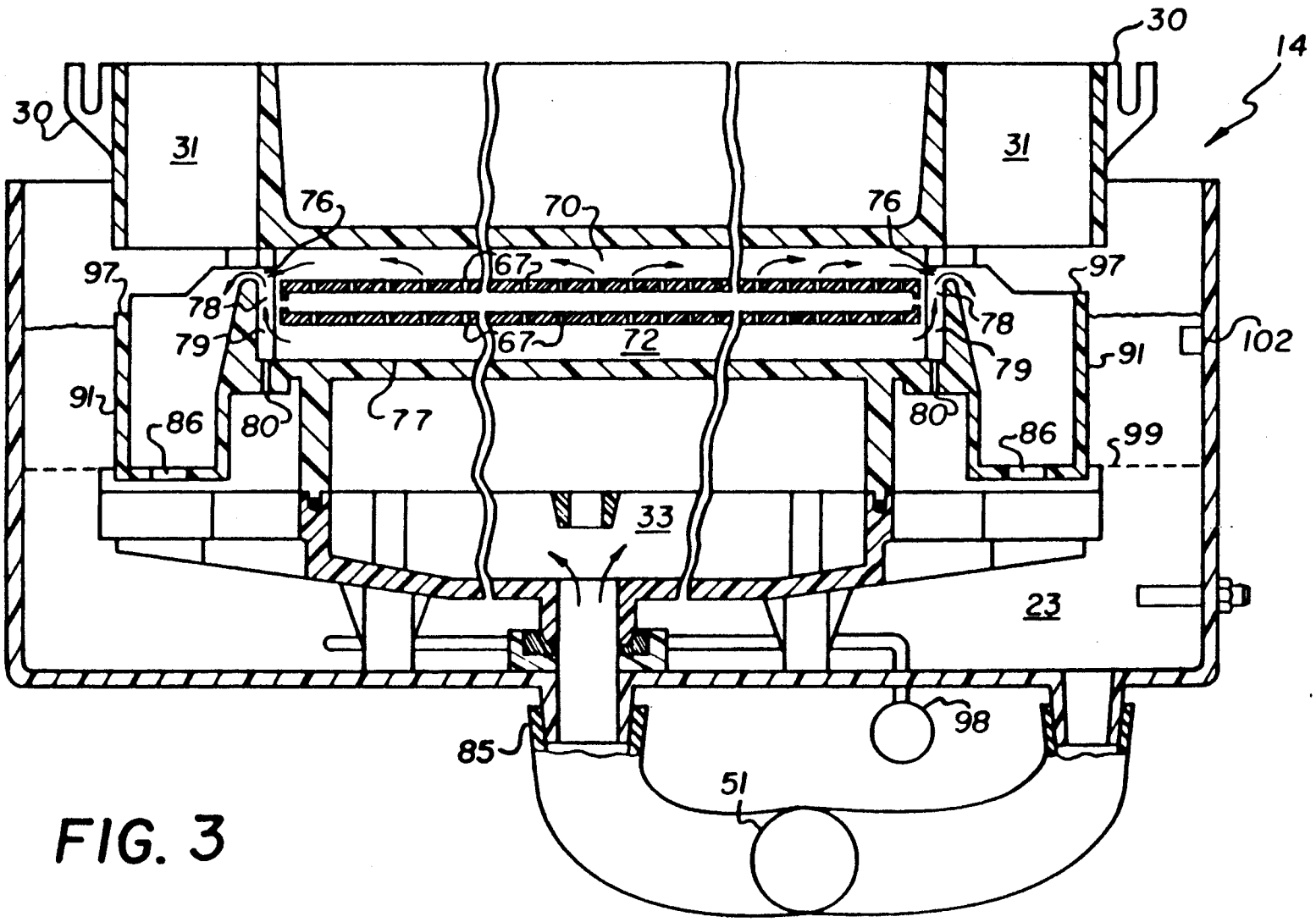
FIG. 3 is a cross-sectional view of the processing unit of FIG. 2 taken along line 3—3.
Figure 4:
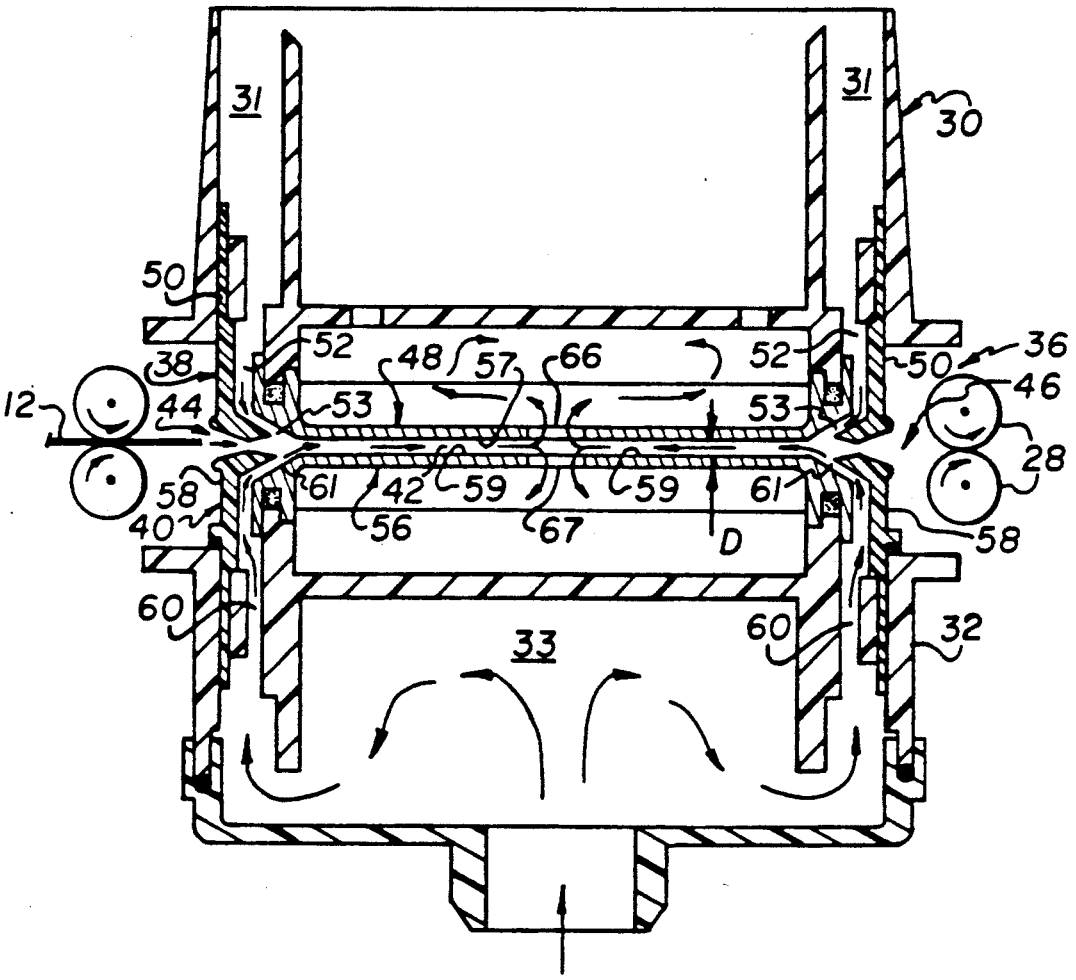
FIG. 4 is a cross-sectional view of processing unit of FIG. 2 as taken along line 4—4.
Figure 5:
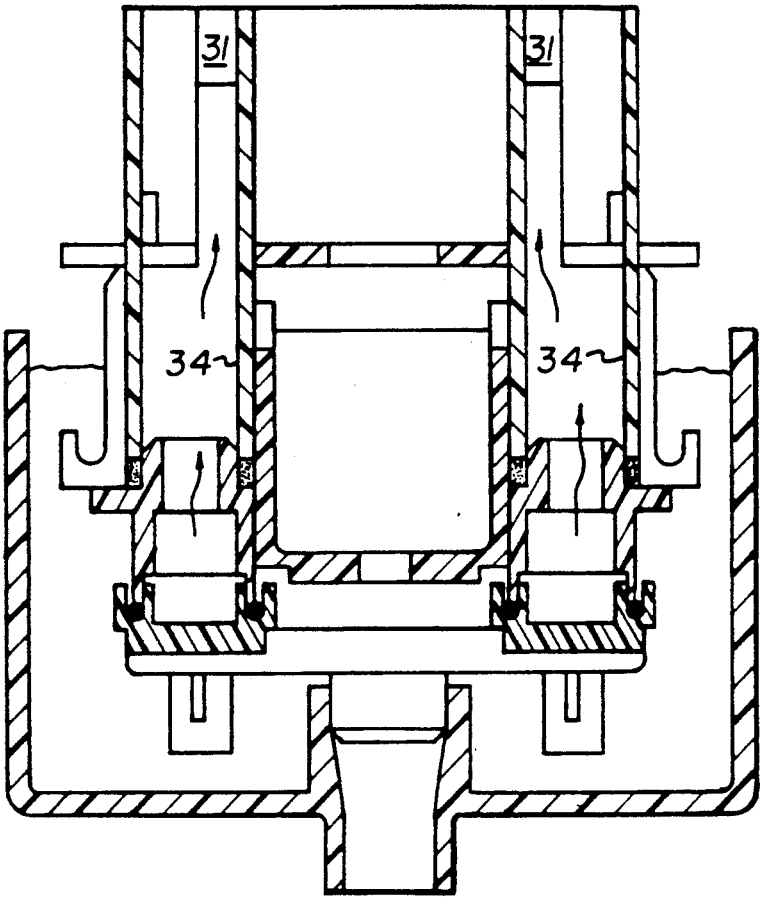
FIG. 5 is a cross-sectional view of the processing unit of FIG. 2 as taken along line 5—5 illustrating how the fluid passes from the lower tank to the upper tank.
Figure 6:
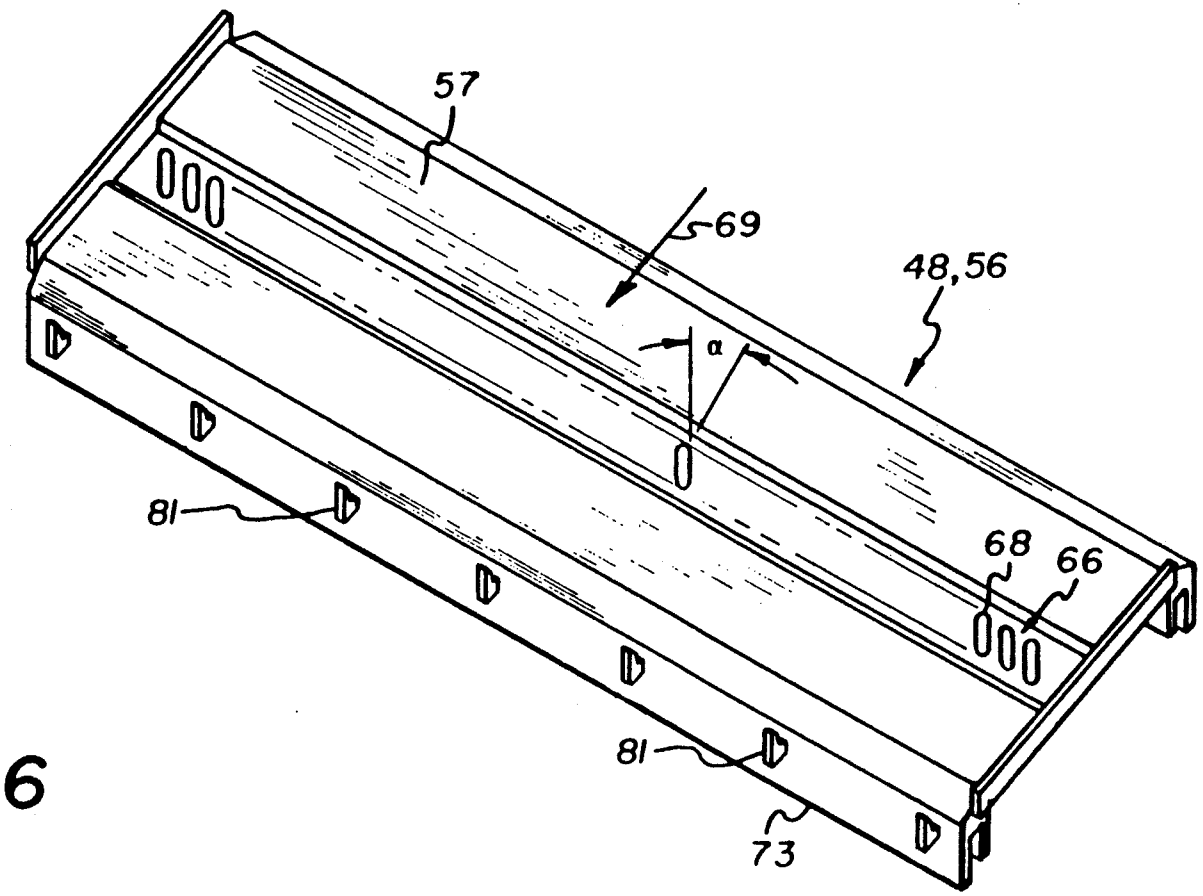
FIG. 6 is a perspective view of one of the inner nozzles illustrating one of the drains through which processing fluid returns to the sump tank for that particular processing unit.

FIG. 1 of the drawings illustrates a photographic processing apparatus made in accordance with the present invention, generally designated 10, that is useful for processing a strip or sheet of photosensitive material 12 (film, paper or other appropriate material). The photographic processing apparatus 10 includes a plurality of photographic processing units, three of which are shown at 14,16 and 18. A processing fluid 22 is supplied to each unit. The processing fluid 22 is generally in a liquid form and includes such photographic processing liquids as developer, fixer, bleach, rinsing fluid, water, or any other fluids for use in the processing of photosensitive material. Any number of photographic processing units can be included in the photographic process apparatus 10 depending upon the number of processing fluids required for processing a specific photosensitive material. The processor may, of course, include other elements typically found in processors. For example, a dryer 20 may be provided for drying of the photosensitive material. Additionally a processing unit made in accordance with the present invention may be combined with other conventional processing units as desired.

A plurality of sump tanks 23,25,27 for holding a processing fluid 22 are provided for units 14,16,18, respectively. The photosensitive material 12 is conveyed through the apparatus 10 by a plurality of nip rollers 28 associated with the photographic processing units 14,16,18. The rollers 28 can be driven by any conventional drive means (not shown).

The photographic processing units 16,18 are the same or similar in construction to the photographic processing unit 14. Therefore only processing unit 14 will be discussed in detail it being understood that the other processing units are similarly constructed. Referring to FIGS. 2–6 processing unit 14 comprises an upper tank 30 and a lower tank 32 having fluid retention chambers 31,33, respectively, for holding processing fluid 22. Four connecting tubes 34 connect the retention chambers 31,33 of tanks 30 and 32 so as to allow processing fluid 22 to flow freely between the upper tank 30 and lower tank 32. The processing unit 14 further includes a processing section 36 located between the upper tank 30 and lower tank 32. The processing section 36 comprises an upper nozzle assembly 38 associated with the upper tank 30 and a lower nozzle assembly 40 associated with lower tank 32. The upper and lower nozzle assemblies 38,40 define a narrow fluid processing chamber 42 through which the photosensitive material 12 travels during processing. The chamber 42 has an entrance 44 through which the photosensitive material enters the chamber 42 and an exit 46 through which the photosensitive material leaves the chamber 42. The upper nozzle assembly 38 includes an inner nozzle 48 and a pair of outer nozzles 50 secured to upper tank 30. The inner and outer nozzles 48, 50 define a pair of passages 52 which are in fluid communication with the fluid retention chamber 31 of the upper tank 30 and a pair of discharge openings/outlets 53 which extend along substantially the entire length of the tank 30 for dispensing of the processing fluid 22 into chamber 42. The outlets 53 allow fluid 22 to enter chamber 42 and create a first fluid layer on one side of the photosensitive material 12. The inner nozzle 48 includes a substantially flat central section 57 which forms the top of chamber 42.

The lower nozzle assembly 40 is similar to the upper nozzle assembly 38 in structure and operation except that it is associated with the lower tank 32. The lower nozzle assembly 38 includes an inner nozzle 56 secured to the top of tank 32 and a pair of outer nozzles 58 also secured to lower tank 32. The inner and outer nozzles 56,58 define a pair of passage 60 which are in fluid communication with the retention chamber 33 of the lower tank 32 and a pair of discharge openings/outlets 61 for dispensing of the fluid into chamber 42 so as to create a second fluid layer on the opposite side of the photosensitive material 12. The inner nozzle 56 comprises a substantially flat central section 59 which forms the bottom of chamber 42. The flat sections 57,59 of inner nozzles 48,56, respectively, from the narrow processing chamber 42. The flat sections are spaced apart such that the photosensitive material may easily pass through the chamber 42 and a thin fluid processing layer is formed on both sides of the photosensitive material 12. In the particular embodiment illustrated, the sections 57,59 are spaced apart a distance D is about 0.125 inches (0.3175 cms) and is designed to receive a film having a thickness of about 0.007 inches (0.0175 cms).

Processing fluid 22 is exhausted from chamber 42 by a pair of drains 66,67 provided in inner nozzles 48,56. Preferably as illustrated the drains 66,67 are located substantially midway between the entrance 44 and exit 46. The drains 66,67 each comprise at least one opening provided in the substantially flat surfaces of inner nozzles 48,56. In the particular embodiment illustrated, drains 66,67 each comprise a plurality of aligned slots 68 disposed at an angle $\alpha$ with respect to the direction of fluid flow (as indicated by arrow 69 in FIG. 6) across the inner nozzles 48,56. However, the drains 66,67 may comprise any desired number of openings 68 having any desired configuration. Conduits or passageways 70,72 are formed between the inner nozzles 48,56 and tanks 30,32 respectively for exhausting the fluid 22 from the chamber 42. The conduits 70,72 terminate in outlets 76,78 for emptying the fluid to the sump tank 23. The conduits 70,72 are configured such that the outlets 76,78 are positioned at substantially the same level so that the fluid back pressure that is experienced at the drains 66,67 is substantially equal. In the particular embodiment illustrated this is achieved by providing a substantially straight conduit 70 having outlet 76 located at a first predetermined level or height and providing conduit 72 with a substantially straight horizontal section 77 and a vertical section 79 which locates outlet 78 at substantially the same level or height as outlet 76. It is, of course, understood that the particular configuration of conduits may take a variety of other shapes so long as the outlets 76,78 remain at substantially the same level.

A pair of weirs 91 are provided adjacent the outlets 76,78 for receiving the processing fluid. Each of the weirs 91 includes a wall having an upper edge 97 which is adjacent the outlets 76,78 and a receiving chamber 84 into which the fluid 22 flows. The weirs 91 each have an opening 86 in the bottom for allowing fluid to return to the sump tank 23. In the particular embodiment illustrated the weirs 91 each have a substantially rectangular configuration and are sized such that the opening 86 is substantially always below the top of the fluid in sump tank 23. The size of opening 86 is such that the level of fluid 22 within weir 91 will be maintained is slightly below the upper edge 97.

A pump 51 is used to draw processing fluid from the sump tank 23 into the lower input 85 of the lower tank 32. The pump 51 causes the fluid 22 to go into the lower chamber 33, which in turn causes the processing fluid 22 to go into vertical tubes 34 so that processing fluid 22 will fill the upper tank 30 as best seen by reference to FIG. 5. This will cause fluid 22 to fill both the upper and lower tanks 30,32 such that substantially equal fluid pressure is applied to the outlets 53,61 at the entrance 44 and exit 46 of the chamber 42.

A pair of small air vent openings 80 are provided in conduits 72 so as to allow processing fluid 22 to drain from conduits 70,72 when the pump 51 is turned off. The openings 80 are small enough so as not to interfere with the substantially equal back pressure experienced by the drains 66,67, but are of a sufficient size to allow fluid 22 to drain from the conduits to the sump tank. In the particular embodiment illustrated, openings 80 each comprise a circular hole having a diameter of about 0.09375 inches (0.238 cms).

As is well known in the art, various other modifications may be made to the processing unit as is customary. For example, in the particular embodiment illustrated, a heat exchanger 98 is provided for cooling of the processing fluid. An optional heater 137 may also be provided for heating of the processing fluid when necessary. While the drawings illustrate the pump 51 located outside of the sump tank 23, it could equally be located within the sump tank 23 if desired. Additionally, appropriate connections may be provided for connecting of the sump tank to the pump and to the lower tank 32 by suitable means.

The present invention is directed to an apparatus for processing photosensitive material which includes an upper and lower tank coupled together so that processing fluid can freely flow between the upper and lower tanks. The processor of the present invention provides a fluid processing layer through which the photosensitive material must pass. The present invention further provides means for providing substantially equal back pressure to both sides of the film, thereby minimizing or eliminating artifacts due to fluttering of the film within the processing chamber.

The invention has been described in detail with particular reference to a preferred embodiment thereof, but it will be understood that variations and modifications can be made without departing from the scope of the present invention. The present invention being limited by the following claims.

I claim:

1. In an apparatus for processing photosensitive material, the apparatus having an upper tank for retaining a processing fluid and a lower tank for retaining the processing fluid, a processing chamber between the upper tank and lower tanks through which the material can be advanced for processing the photosensitive material, said processing chamber having an entrance at one end and an exit at the other end to allow the photosensitive material to travel through the chamber, first supply means at the entrance and exit for supplying processing fluid from the upper tank to the processing chamber to create a first fluid layer on one side of the photosensitive material, a first drain located between the entrance and exit for removing processing fluid from the second fluid layer, second supply means at the entrance and exit for supplying processing fluid from the lower tank to the processing chamber to create a second fluid layer on the opposite side of the photosensitive material, a second drain located between the entrance and exit for removing processing fluid from the second fluid layer; the improvement comprising:

means for substantially equalizing the back pressure of the processing fluid at the first and second drains.

2. In an apparatus according to claim 1 wherein said means for substantially equalizing the back pressure of the processing fluid at the first and second drains comprises a first duct having an inlet and outlet, the inlet of the first duct being connected to the first drain and the outlet of the first duct being fluidly connected to a sump tank, and a second duct having an inlet and outlet, the inlet of the second duct being connected to the second drain and the outlet of the second duct being fluidly connected to the sump tank, the outlets of the first and second ducts being positioned at substantially the same level.

3. In an apparatus according to claim 1 wherein the first drain is located substantially midway between the entrance and exit.

4. In an apparatus according to claim 1 wherein the second drain is located substantially midway between the entrance and exit.

5. In an apparatus according to claim 1 further comprising means coupling the upper and lower tanks together so that processing fluid can freely flow between the tanks.

6. A photographic processing apparatus for processing a photosensitive material, said apparatus comprising:

at least one fluid suspension device for applying a processing fluid to a photosensitive material, said at least one fluid suspension device having an upper tank for retaining a processing fluid and a lower tank for retaining the processing fluid, a processing chamber between the upper tank and lower tanks through which the photosensitive material can be advanced for processing the photosensitive material, said processing chamber having an entrance at one end an exit at the other end to allow the photosensitive material to travel through the processing chamber, first supply means at the entrance and exit for supplying processing fluid from the upper tank to the processing chamber to create a first fluid layer on one side of the photosensitive material, a first drain located between the entrance and exit for removing processing fluid from the first fluid layer, second supply means at the entrance and exit for supplying processing fluid from the lower tank to the processing chamber to create a second fluid layer on the opposite side of the photosensitive material, a second drain located between the entrance and exit for removing processing fluid from the second fluid layer and means for substantially equalizing the back pressure of the processing fluid at the first and second drains.

7. In an apparatus for processing photosensitive material, the apparatus having, a processing chamber through which a photosensitive material can be advanced for processing of the photosensitive material, said processing chamber having an entrance and an exit to allow the photosensitive material to travel through the processing chamber, first supply means for supplying processing fluid to the processing chamber to create a first fluid layer on one side of the photosensitive material, a first drain for removing processing fluid from the first fluid layer, second supply means for supplying processing fluid to the processing chamber to create a second fluid layer on the opposite side of the photosensitive material, a second drain for removing processing fluid from the second fluid layer; the improvement comprising:

means for substantially equalizing the back pressure of the processing fluid at the first and second drains.

8. In an apparatus according to claim 7 wherein said means for substantially equalizing the back pressure of the processing fluid at the first and second drains comprises a first duct having an inlet and outlet, the inlet of the first duct being connected to the first drain and the outlet of the first duct being fluidly connected to a sump tank, and a second duct having an inlet and outlet, the inlet of the second duct being connected to the second drain and the outlet of the second duct being fluidly connected to the sump tank, the outlets of the first and second ducts being positioned at the same level.

9. In an apparatus according to claim 7 wherein the first drain is located at the opposite end of the chamber from where the first supply means is located.

10. In an apparatus according to claim 7 wherein the second drain is located at the opposite end of the chamber from where the second supply means is located.

11. In an apparatus according to claim 7 wherein said first supply means is located at the entrance or exit of the chamber.

12. In an apparatus according to claim 7 wherein said second supply means is located at the entrance or exit of the chamber.

13. A photographic processing apparatus for processing a photosensitive material, said apparatus comprising:

at least one fluid suspension device for applying a processing fluid to a photosensitive material, said at least one fluid suspension device having a processing chamber through which a photosensitive material can be advanced for processing the photosensitive material, said processing chamber having an entrance and an exit to allow the photosensitive material to travel through the processing chamber, first supply means for supplying processing fluid to the processing chamber to create a first fluid layer on one side of the photosensitive material, a first drain for removing processing fluid from the first fluid layer, second supply means for supplying processing fluid to the processing chamber to create a second fluid layer on the opposite side of the photosensitive material, a second drain for removing processing fluid from the second fluid layer and means for substantially equalizing the back pressure of the processing fluid at the first and second drains.

14. A photographic processing apparatus according to claim 13 wherein said means for substantially equalizing the back pressure of the processing fluid at the first and second drains comprises a first duct having an inlet and outlet, the inlet of the first duct being connected to the first drain and the outlet of the first duct being fluidly connected to a sump tank, and a second duct having an inlet and outlet, the inlet of the second duct being connected to the second drain and the outlet of the second duct being fluidly connected to the sump tank, the outlets of the first and second ducts being positioned at the same level.

15. A photographic processing apparatus according to claim 13 wherein the first drain is located at the opposite end of the chamber from where the first supply means is located.

16. A photographic processing apparatus according to claim 13 wherein the second drain is located at the opposite end of the chamber from where the second supply means is located.

17. A photographic processing apparatus according to claim 13 wherein said first supply means is located at the entrance or exit of the chamber.

18. A photographic processing apparatus according to claim 13 wherein said second first supply means is located at the entrance or exit of the chamber.

19. In an apparatus for processing photosensitive material, the apparatus having an upper tank for retaining a processing fluid and a lower tank for retaining the processing fluid, a narrow processing chamber between the upper tank and lower tanks through which the material can be advanced for processing the photosensitive material, said processing chamber having an entrance at one end and an exit at the other end to allow the photosensitive material to travel through the chamber, first supply means at the entrance and exit for supplying processing fluid from the upper tank to the processing chamber to create a first fluid layer on one side of the photosensitive material, a first drain located between the entrance and exit for removing processing fluid from the first fluid layer, second supply means at the entrance and exit for supplying processing fluid from the lower tank to the processing chamber to create a second fluid layer on the opposite side of the photosensitive material, a second drain located between the entrance and exit for removing processing fluid from the second fluid layer; the improvement comprising:

means for substantially equalizing the back pressure of the processing fluid at the first and second drains.

20. In an apparatus according to claim 19 wherein said means for substantially equalizing the back pressure of the processing fluid at the first and second drains comprises a first duct having an inlet and outlet, the inlet of the first duct being connected to the first drain and the outlet of the first duct being fluidly connected to a sump tank, and a second duct having an inlet and outlet, the inlet of the second duct being connected to the second drain and the outlet of the second duct being fluidly connected to the sump tank, the outlets of the first and second ducts being positioned at substantially the same level.

21. In an apparatus according to claim 19 wherein the first drain is located substantially midway between the entrance and exit.

22. In an apparatus according to claim 19 wherein the second drain is located substantially midway between the entrance and exit.

23. In an apparatus according to claim 19 further comprising means coupling the upper and lower tanks together so that processing fluid can freely flow between the tanks.

24. A photographic processing apparatus for processing a photosensitive material, said apparatus comprising:

at least one fluid suspension device for applying a processing fluid to a photosensitive material, said at least one fluid suspension device having an upper tank for retaining a processing fluid and a lower tank for retaining the processing fluid, a narrow processing chamber between the upper tank and lower tanks through which the photosensitive material can be advanced for processing the photosensitive material, said processing chamber having an entrance at one end and an exit at the other end to allow the photosensitive material to travel through the processing chamber, first supply means at the entrance and exit for supplying processing fluid from the upper tank to the processing chamber to create a first fluid layer on one side of the photosensitive material, a first drain located between the entrance and exit for removing processing fluid from the first fluid layer, second supply means at the entrance and exit for supplying processing fluid from the lower tank to the processing chamber to create a second fluid layer on the opposite side of the photosensitive material, a second drain located between the entrance and exit for removing processing fluid from the second fluid layer and means for substantially equalizing the back pressure of the processing fluid at the first and second drains.

* * * * *

UNITED STATES PATENT AND TRADEMARK OFFICE

CERTIFICATE OF CORRECTION

PATENT NO. : 5,317,359

DATED : May 31, 1994

INVENTOR(S) : David G. Sherburne

It is certified that error appears in the above-indentified patent and that said Letters Patent is hereby corrected as shown below:

Col. 5, line 35, delete "second" and insert --first--

Col. 6, line 13, after "one end" insert --and--.

Signed and Sealed this

Thirteenth Day of September, 1994

*Attest:*

*Attesting Officer*

Bruce Lehman

BRUCE LEHMAN

*Commissioner of Patents and Trademarks*